US010571087B2

(12) United States Patent
Kildeby

(10) Patent No.: US 10,571,087 B2
(45) Date of Patent: Feb. 25, 2020

(54) PROJECTING LIGHT FIXTURE WITH SINGLE WHEEL

(71) Applicant: Harman Professional Denmark ApS, Aarhus N (DK)

(72) Inventor: Nina Lillelund Kildeby, Gedved (DK)

(73) Assignee: Harman Professional Denmark ApS (DK)

( * ) Notice: Subject to any disclaimer, the term of this patent is extended or adjusted under 35 U.S.C. 154(b) by 0 days.

(21) Appl. No.: 16/401,591

(22) Filed: May 2, 2019

(65) Prior Publication Data

US 2019/0346100 A1 Nov. 14, 2019

(30) Foreign Application Priority Data

May 11, 2018 (EP) ..... 18171851

(51) Int. Cl.
*F21S 10/00* (2006.01)
*F21V 14/08* (2006.01)

(52) U.S. Cl.
CPC ..... *F21S 10/007* (2013.01); *F21V 14/08* (2013.01)

(58) Field of Classification Search
CPC ..... F21S 10/007; F21V 14/08
See application file for complete search history.

(56) References Cited

U.S. PATENT DOCUMENTS

| | | | | |
|---|---|---|---|---|
| 5,934,794 | A * | 8/1999 | Hutton | F21S 10/007 362/283 |
| 2011/0083847 | A1 | 3/2011 | Quadri | |
| 2011/0090708 | A1* | 4/2011 | Salm | F21S 10/007 362/449 |
| 2016/0069540 | A1 | 3/2016 | Kjeldsen et al. | |
| 2016/0084457 | A1* | 3/2016 | Junk | F21S 10/007 362/324 |
| 2018/0283632 | A1* | 10/2018 | Rasmussen | G03B 25/00 |

* cited by examiner

*Primary Examiner* — Anne M Hines
(74) *Attorney, Agent, or Firm* — Angela M. Brunetti

(57) ABSTRACT

A projecting light fixture having at least one light source generating a source light beam and an optical gate illuminated by the source light beam. A single support wheel is located near the optical gate and a plurality of gobo wheels are provided on the single support wheel. Each gobo wheel has a gobo beam shaping object. A beam shaping plate having a plurality of plate beam shaping objects is fixedly connected to the single support wheel in a position where each plate beam shaping object fixedly placed in front of one of the gobo wheels is facing the one gobo wheel, and a control unit is configured to rotate each of the gobo wheels with its gobo beam shaping object relative to the beam shaping plate.

12 Claims, 12 Drawing Sheets

PROJECTING LIGHT FIXTURE WITH SINGLE WHEEL

CROSS REFERENCE

Priority is claimed to application serial no. 18171851.1, filed May 11, 2018 in Europe, the disclosure of which is incorporated in its entirety by reference.

TECHNICAL FIELD

The present application relates to a projecting light fixture where an optical gate is illuminated by at least one light source.

BACKGROUND

For the creation of various light effects and mood lighting in concerts, live shows, TV shows, sport events, or as part of an architectural installation, light fixtures creating various light effects are getting more and more appreciated in the industry. Typically, entertainment light fixtures create a light beam having a beam width and a divergence and can for instance be wash/flood light fixtures creating a relatively wide light beam or can be a projecting fixture configured to project images onto a target surface or into the air.

Projecting light fixtures typically comprise one or more optical gates illuminated by the hat system, and an optical projecting module is configured to collect the light passing through the optical gate along an optical axis. A beam shaping object can be arranged at the optical gate or near the optical gate and may be used to shape the light beam. The optical gate may be delimited by an aperture, however, it is to be understood that a physical aperture can be omitted and that the beam shaping optic can also constitute the aperture. The beam shaping object can also be used to create midair effects which are visible due to the light scattering on smoke in the air, where the shape of the light beam in the midair is defined by the beam shaping object. The beam shaping object may also create a light pattern which is projected as an image onto a target surface.

The beam shaping objects can be used as static objects arranged in the light beam and/or as dynamic objects which are moved in relation to the light beam in order to create dynamic light effects.

Light designers and programmers want as many different effects as possible in a light fixture, as this gives the light designers and programmers many options when creating light effects. However, it is difficult to provide lighting fixtures with many effects as for each light effect a component has to be provided which takes up space in the housing of the light fixture. Especially, it is difficult to provide many different beam shaping objects in a projecting light system as the beam shaping objects need to be positioned in a focal plane of the optical system, and typically the light fixture is only capable of focusing in a very limited area. At the same time the light fixture should be easy to handle and compact in size.

Accordingly, there is a need to provide a light fixture configured to generate different light effects which has a compact size.

SUMMARY

This need is met by the features of the independent claims. Further aspects are described in the dependent claims.

According to one or more aspects a projecting light fixture is provided comprising at least one light source configured to generate at least one source light beam propagating along an optical axis. The light fixture comprises an optical gate wherein the at least one source light beam illuminates the optical gate. Furthermore, the projecting light fixture comprises a single support wheel located near the optical gate wherein a plurality of gobo wheels are provided on the single support wheel, and wherein each gobo wheel comprises a gobo beam shaping object rotatable around its gobo wheel axis. The single support wheel is rotatable around its support wheel axis such that one of the plurality of gobo wheels is placed with its gobo beam shaping object in the at least one source light beam. The projecting light fixture furthermore comprises a beam shaping plate with a plurality of plate beam shaping objects. The beam shaping plate is fixedly connected to the single support wheel in a position where each plate beam shaping object fixedly placed in front of one of the gobo wheels is facing the one gobo wheel. The at least one source light beam passing through one of the gobo wheels is at least partly blocked by the gobo beam shaping object of the one gobo wheel and the corresponding plate beam shaping object facing the one gobo wheel. A control unit of the light fixture is configured to rotate each of the gobo wheels with its gobo beam shaping object relative to the beam shaping plate around the gobo wheel axis.

Accordingly, the light fixture has a single support wheel with gobo wheels placed on it and the beam shaping plate fixedly connected to the single support wheel. With the rotation of the gobo wheels and the corresponding gobo beam shaping objects relative to the plate beam shaping objects various light effects can be obtained comparable to the situation where two support wheels with gobo wheels are provided. Accordingly, with an arrangement with low space requirements a variety of different light effects can be generated.

It is to be understood that the features mentioned above and features yet to be explained below can be used not only in the respective combinations indicated, but also in other combinations or in isolation without departing from the scope of the present application. Features of the above-mentioned aspects and embodiments described below may be combined with each other in other embodiments unless explicitly mentioned otherwise.

DETAILED DESCRIPTION

Figure 1:
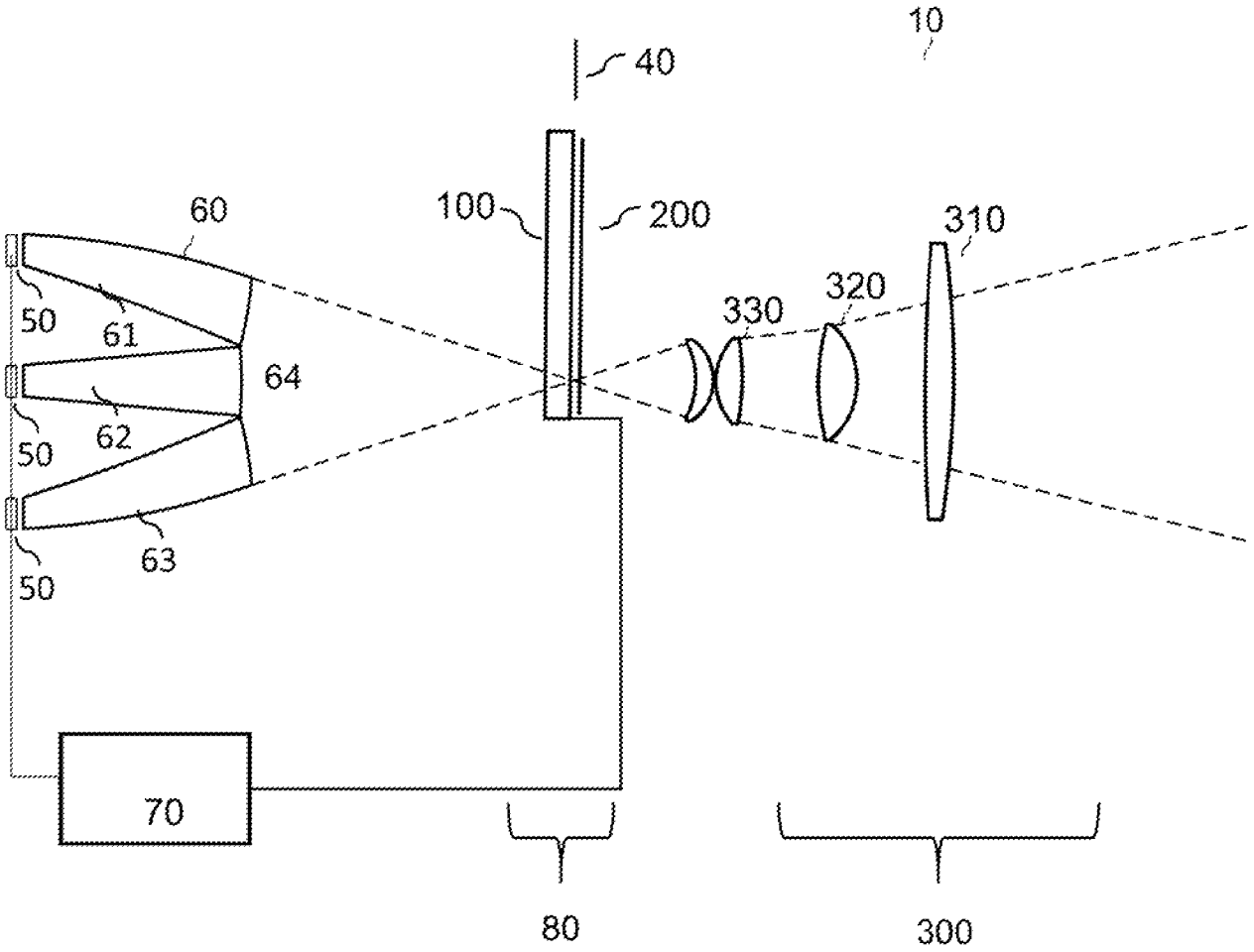
FIG. 1 shows a schematic view of a light fixture providing a variety of light effects in a structure with low space requirements.

In the following embodiments of the invention be described in detail with reference to the accompanying drawings. It is to be understood that the following description of embodiments is not to be taken in a limiting sense. The scope of the invention is not intended to be limited by the embodiments described hereinafter or by the drawings full, which are to be illustrative only.

The drawings are to be regarded as being schematic representations, and elements illustrated in the drawings are not necessarily shown to scale. Rather the various elements are represented such that their function and general purpose becomes apparent to a person skilled in the art. Any connection or coupling between functional blocks, devices, components of physical or functional units shown in the drawings and described hereinafter may also be implemented by an indirect connection or coupling.

A coupling between components may be established or wired over wireless connection.

FIG. 1 shows a schematic sectional view of a light fixture 10 providing different animation effects and which has a great freedom to create unique lighting effects. The light fixture 10 comprises a plurality of light sources 50 which are located in front of a light collecting element 60. The light collecting element 60 comprises a plurality of light collecting legs 61-63 which collect and mix the light and emit the light at a light exit surface 64 of the light collecting element 60. For the sake of clarity only three of the light collecting legs are shown, however, the light collecting element may have six or seven light collecting legs.

A plurality of light sources 50 is preferably located in front of each of the light collecting legs, preferably light sources of different colour. The light generated by these light sources is collected and mixed by the different light collecting legs and is focused by the geometry of the light collecting legs to different light beams which are focused at an optical gate 40 where a light effect system 80 with a support wheel 100 and a beam shaping plate 200 is provided. As will be explained in connection with FIGS. 2 and 3 the single support wheel comprises a plurality of gobo wheels which are each rotatable around its axis wherein the single support wheel is also rotatable such that one of the gobo wheels is placed in the light beams generated by the light collecting legs.

The light collecting element 60 in its shape as described in further detail in the European application having the filing number EP 18 159 354.2. For the shape of the light collecting element 60 reference is made to this application.

After passing through the light effect system a projecting system 300 is provided which is configured to project an image of the optical gate or a plane in the proximity of this gate onto the target surface along the optical axis. The projecting system 300 comprises a front lens 310, a zoom group 320 and a focus group 330. The projecting system can be designed with any number of lens groups.

The light sources can be LEDs, wherein preferably a group of LEDs is located in front of each light collecting legs 61-63. Preferably LEDs of different colours are provided in front of each light collecting leg and are arranged such that the light of this group of LEDs illuminates one leg entrance surface of a light collecting leg.

It should be noted that any kind of light sources such as discharge lamps, OLEDs, PLEDs, plasma sources, hollow light sources and plasma light sources, laser and combinations might be used. Each of the light sources is connected to a control unit 70 configured to individually control each of the light sources. As a consequence it is possible to generate different illuminations to the light collecting legs and thus to the optical gate and these illuminations can be used to create different light effects.

The control unit 70 is also connected to the single support wheel and is configured to rotate the single support wheel such that one of the gobo wheels is placed in the light beam.

Instead of the light collecting element 60 a plurality of optical lenses may be provided which focus the light beam near the optical gate 40.

This will be explained in more detail in connection with FIGS. 2 and 3.

Figure 2:
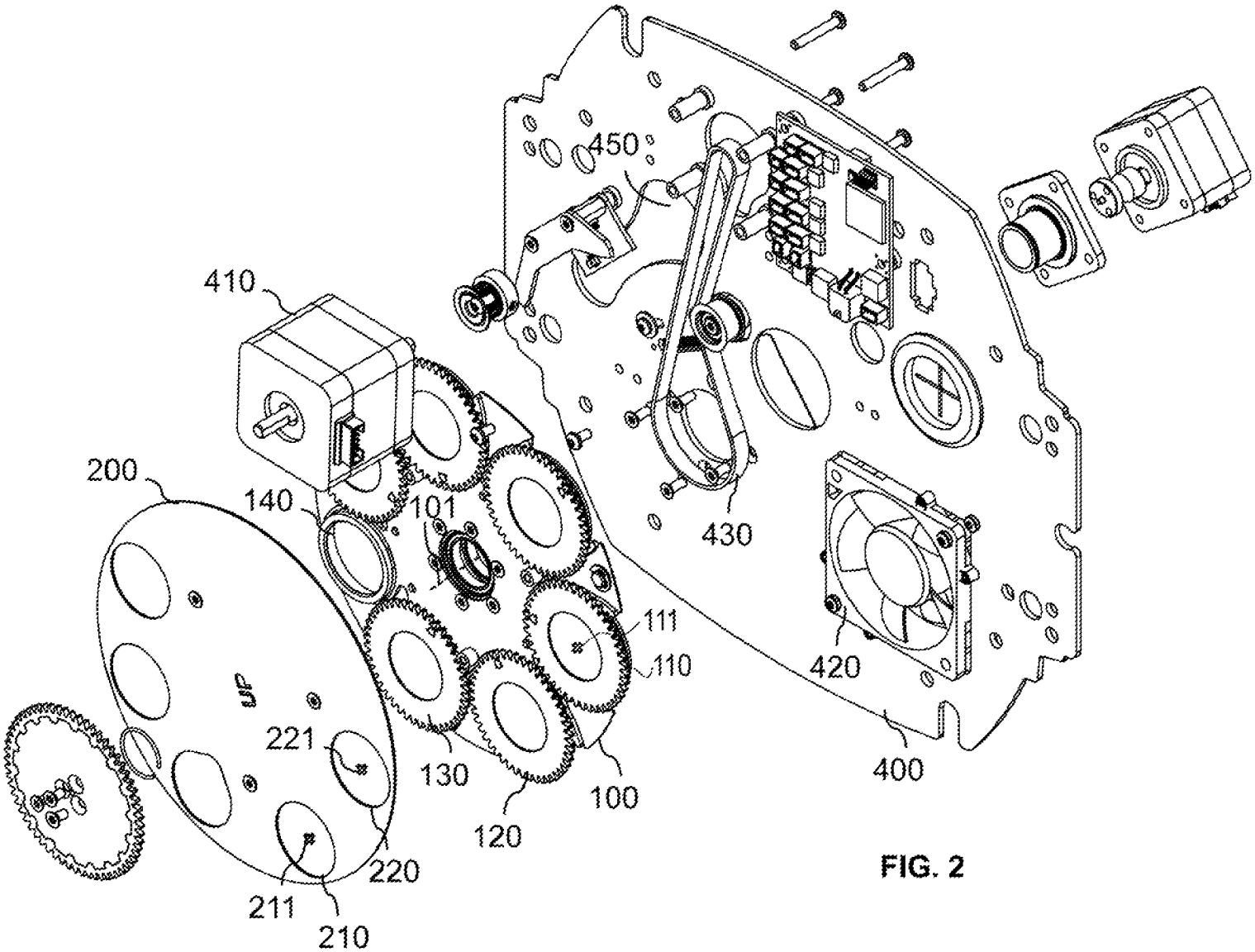
FIG. 2 shows an exploded view of parts of the projecting light fixture showing the arrangement of the single support wheel and the beam shaping plate relative to one another.

FIG. 2 shows an exploded rear view of the light effect system 80 comprising the beam shaping plate 200 and the single support wheel 100. The light sources (not shown) are provided on the right side of FIG. 2. As shown especially in FIG. 2 the support wheel 100 comprises a plurality of gobo wheels 110, 120, 130. In the embodiment shown six gobo wheels are present on the support wheel wherein one through opening 140 is provided without a gobo wheel. Each of the gobo wheels is rotatable around its center axis such as axis 111 shown for gobo wheel 110. Each gobo wheel comprises in the central part of the gobo wheel a gobo beam shaping object not shown in FIGS. 2 and 3 but which are explained in further detail in connection with FIGS. 4 to 9. The support wheel 100 is rotatable around its center axis 101 in such a way that one of the gobo wheels with its gobo beam shaping object is placed in the light beam generated by the light sources 50 and directed by the light collecting element 60. Each of the gobo wheels can be rotated individually on the support wheel 100. Furthermore, the beam shaping plate 200 is fixedly connected to the support wheel 100. In the embodiment shown in FIG. 2 the beam shaping plate 200 comprises receiving structures 210, 220 for receiving plate beam shaping objects which are not shown in FIG. 2 but which are explained in further detail in connection with FIGS. 4 to 9. The receiving structure has a circular outer boundary with a corresponding center 211 or 221 and the size of the receiving structure 210, 220 is preferably such that it corresponds to the size provided in the gobo wheels for the global beam shaping objects. The beam shaping plate is fixedly connected to the single support wheel 100 such that one receiving structure 210, 220 is facing one of the gobo wheels, and the gobo wheels and the plate beam shaping object are placed concentrically one above the other so that in the direction of the optical axis the center 221 coincides with the center 111 et cetera. The beam shaping plate cannot be rotated relative to the support wheel 100, however, each gobo wheel can be rotated with its gobo beam shaping object relative to the plate beam shaping object provided in the receiving structures 210 and 220. The support wheel 100 is connected to a support plate 400 wherein a motor 410 is provided controlled by control unit 70 and which controls the rotation of the single support wheel 100. Furthermore, a heat dissipating element 420 is provided in the support plate 400 and can help to cool the light sources and the whole structure and the motor 410 drives a mechanism 430 allowing the rotation of the single support wheel 100. The support plate 400 furthermore comprises an opening 450 which is illuminated by the light beam generated by the light fixtures of FIG. 1.

Figure 3:
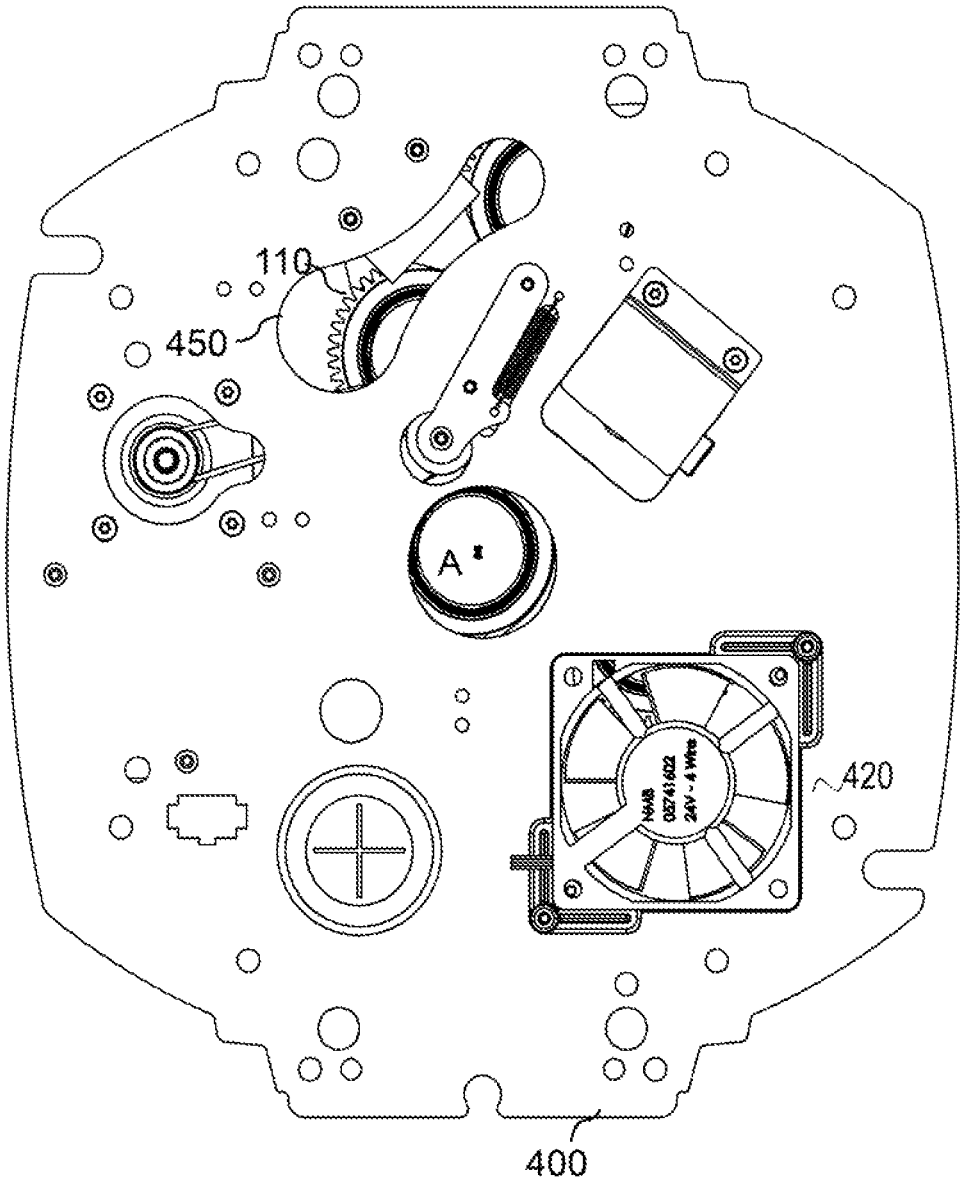
FIG. 3 shows a front view of the components shown in FIG. 2 in an assembled state.

FIG. 3 shows a front view of the support plate 400 with the opening 450 wherein one of the gobo wheels such as gobo wheel 110 is shown which can be rotated such that the opening in the gobo wheel is placed in the opening 450. The light sources 50 illuminate the face of the support plate shown in FIG. 3.

Figure 4A:
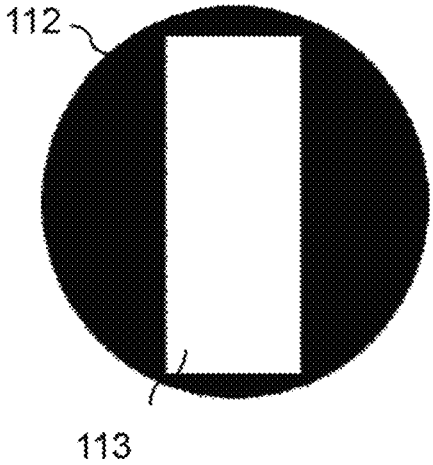
FIGS. 4*a* to 4*f* show a first example of a gobo beam shaping object and of a plate beam shaping object and the effects obtained when the gobo beam shaping object is rotated relative to the plate beam shaping object.
Figure 4B:
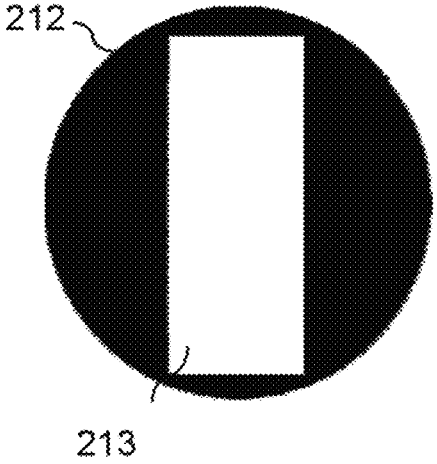
Figure 4C:
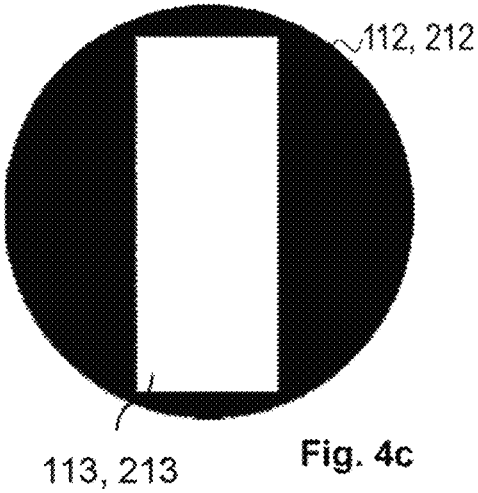
Figure 4D:
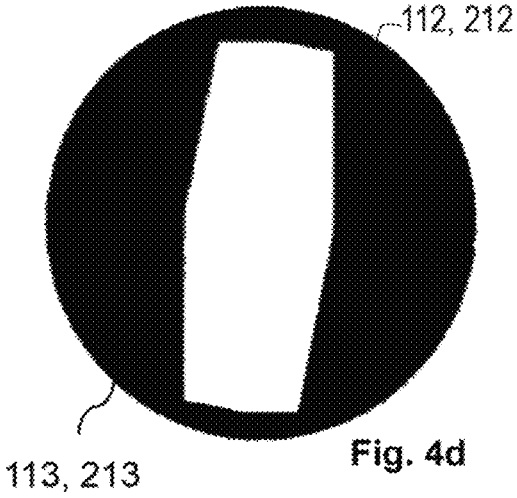
Figure 4E:
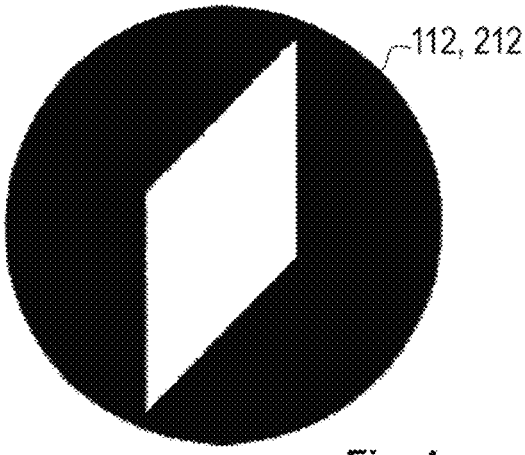
Figure 4F:
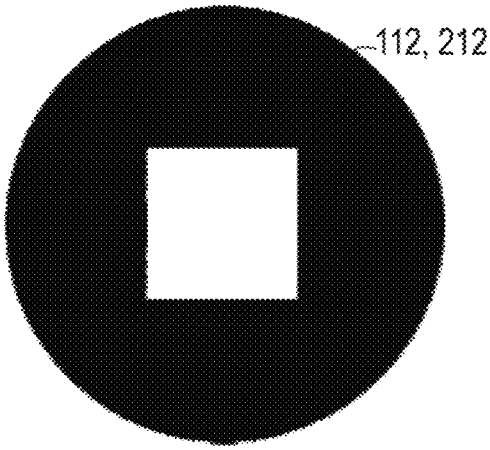

FIGS. 4*c*-4*f* show a first example of a gobo beam shaping object and the corresponding plate beam shaping object which are placed one above the other. FIGS. 4*c*-4*f* also show the effects obtained when the gobo beam shaping object is rotated relative to the plate beam shaping object. In FIG. 4*a* a first gobo beam shaping object 112 is shown which has a circular outer boundary and which blocks the light except in the rectangular opening 113. In FIG. 4*b* the plate beam shaping object 212 is shown which is placed directly above the gobo wheel in one of the receiving structures. In the second row shown in FIG. 4*c* the two beam shaping objects 112, 212 are placed one above the other in a position as in the final product, wherein in FIG. 4*c* the rectangular opening 113 is placed in the same rotation angle above a rectangular opening 213 provided in the corresponding beam shaping object. In FIG. 4*d* the gobo beam shaping object 112 is slightly tilted by the rotation of the corresponding gobo wheel so that the effective opening is obtained as shown. In FIG. 4*e* the gobo wheel is rotated by approximately 45° relative to the position shown in FIG. 4*e* wherein in FIG. 4*f* the gobo beam shaping object is rotated by 90° relative to the fixed plate beam shaping object.

As can be seen from FIGS. 4*a*-4*f*, by rotating the gobo wheel several light effects an be obtained when one of the gobo wheels is illuminated.

In the embodiment of FIGS. 4*a*-4*f* both the gobo beam shaping object and the plate beam shaping object have the same shape, where a part of the light beam outside the rectangular section at the center is blocked. In the embodiment shown in FIGS. 4*a*-4*f* to FIGS. 9*a*-9*f* the areas shown by black patterns are opaque and block the light whereas the white parts shown in the FIGS. 4*a*-4*f* to FIGS. 9*a*-9*f* pass the light.

Figure 5A:
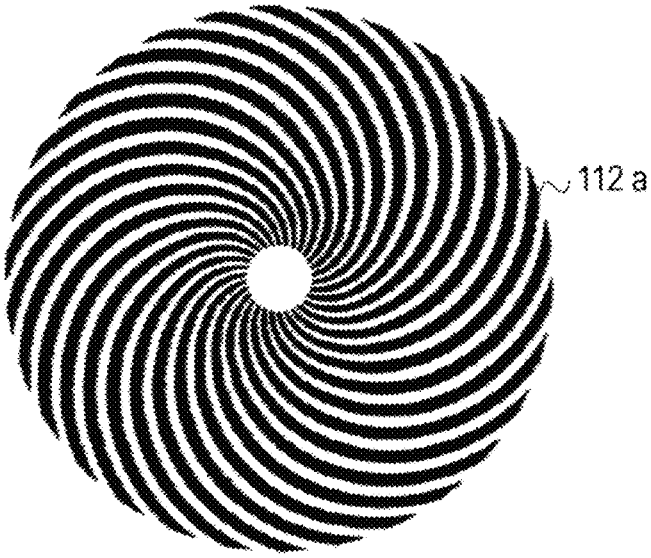
FIGS. 5*a* to 5*c* show another example of a gobo beam shaping object and of a plate beam shaping object before and after they are placed above one another.
Figure 5B:
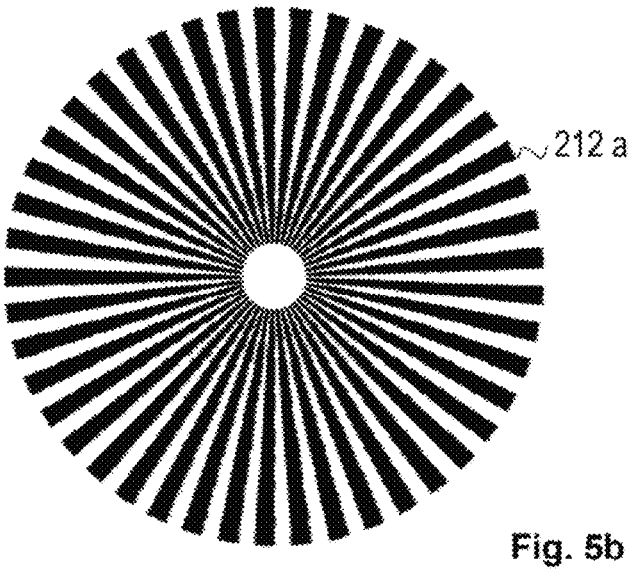
Figure 5C:
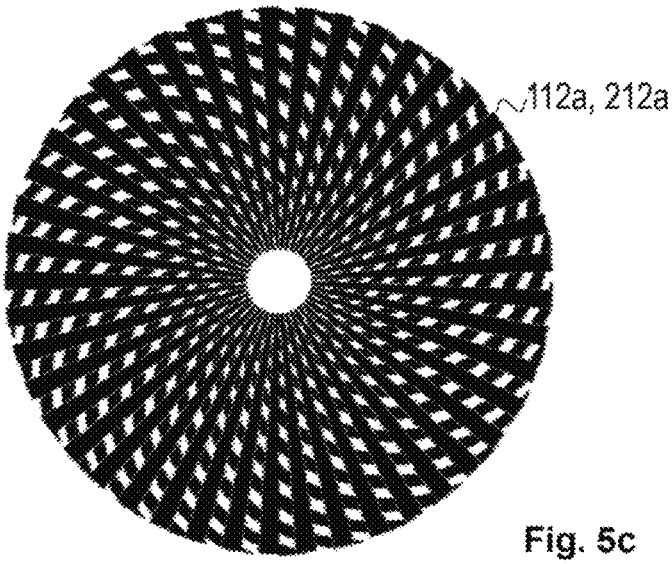

In FIGS. 5*a*-5*c* a further example is shown. In the example shown in FIG. 5*a* the gobo beam shaping object 112*a* can be a spirally shaped pattern whereas in FIG. 5*b* the beam shaping object 212*a* comprises linear extending spokes which radially extend from the center to the outside. When these two beam shaping objects are placed one above the other, a pattern is obtained as shown in FIG. 5*c*. When now the gobo beam shaping, object is rotated relative the plate beam shaping object the Moiré effects can be obtained.

Figure 6A:
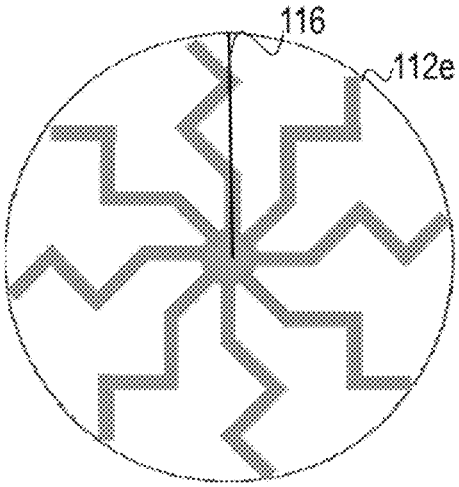
FIGS. 6*a* to 6*f* show a further example of a gobo beam shaping object and a plate beam shaping object and the pattern generated when the gobo beam shaping object is rotated relative to the plate beam shaping object.
Figure 6B:
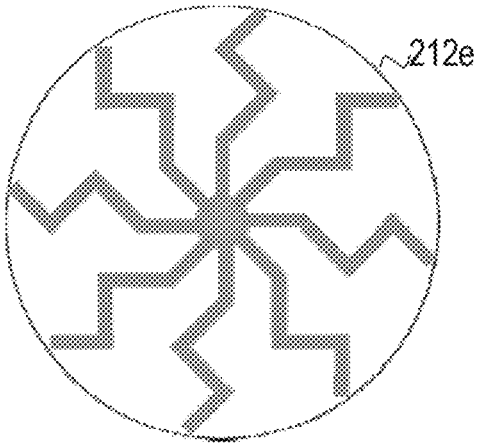
Figure 6C:
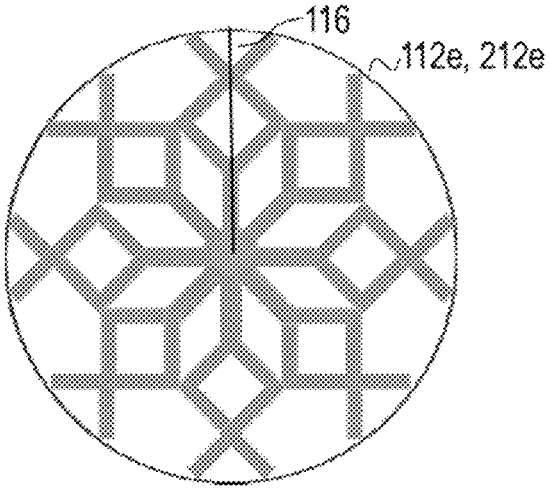
Figure 6D:
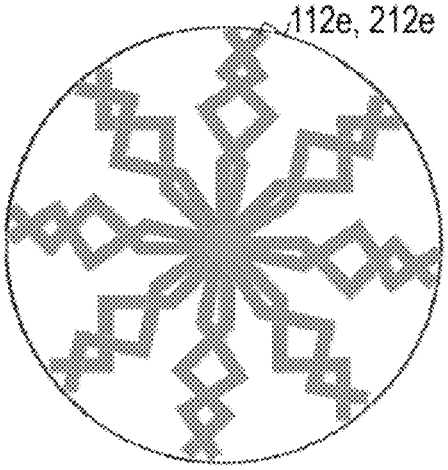
Figure 6E:
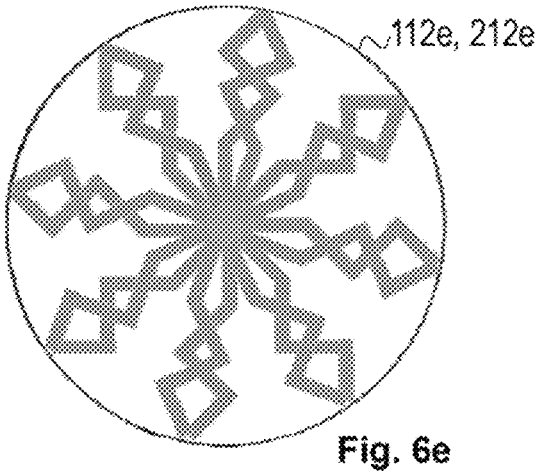
Figure 6F:
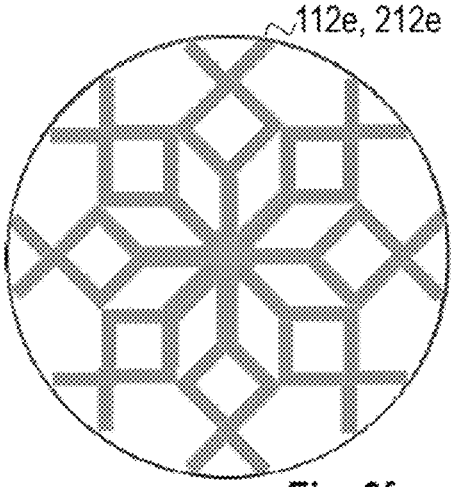

FIGS. 6*c* -6*f* show the generation of snowflakes in which the gobo beam shaping pattern 112*e* of FIG. 6*a* and the plate beam shaping object 212*e* shown in FIG. 6*b* provide in a superposition shown in FIG. 6*c* a snowflake. The shape of the radial components of the gobo beam shaping object and the plate beam shaping object are such that they are symmetrical to an axis 116 as shown in FIGS. 6*c* to 6*f*. FIG. 6*d* and FIG. 6*e* show a superposition of the gobo beam shaping object as it is rotated relative to the plate beam shaping object 212*e*. FIG. 6*f* shows the gobo beam shaping object 112*e* and the plate beam shaping object 212*e* in a superposition where each is again aligned with axis 116.

Figure 7A:
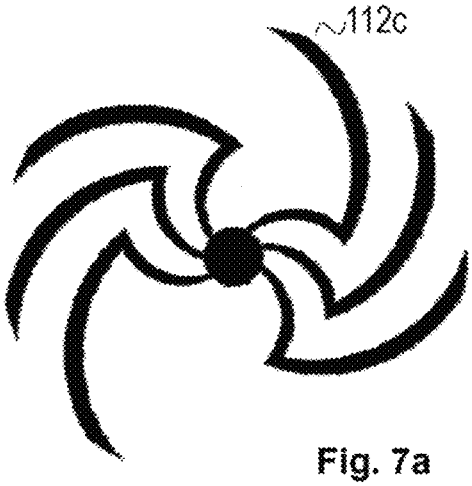
FIGS. 7*a* to 7*f* show a further example of a gobo beam shaping object and a plate beam shaping object and the pattern obtained when the gobo beam shaping object is rotated relative to the plate beam shaping object.
Figure 7B:
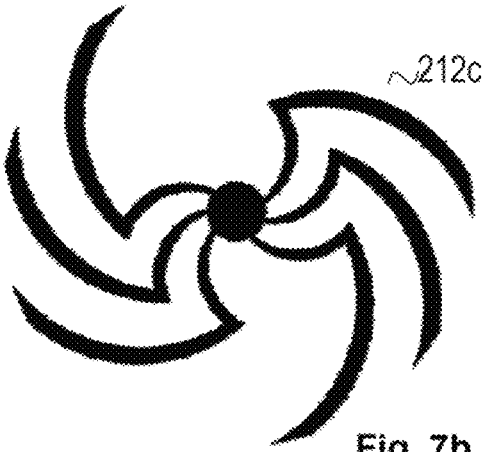
Figure 7C:
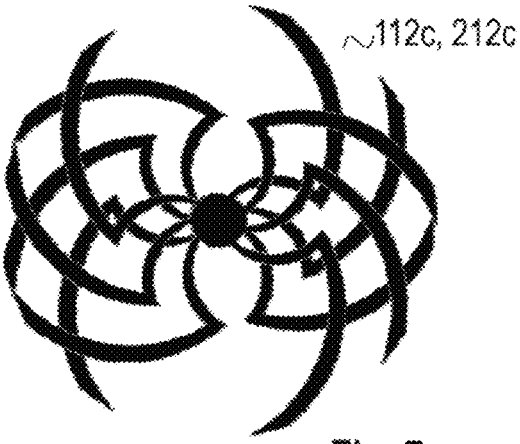
Figure 7D:
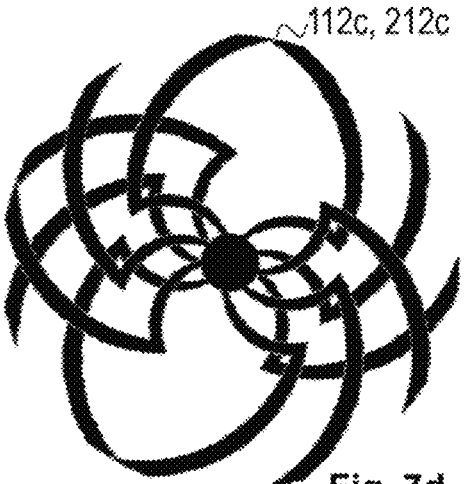
Figure 7E:
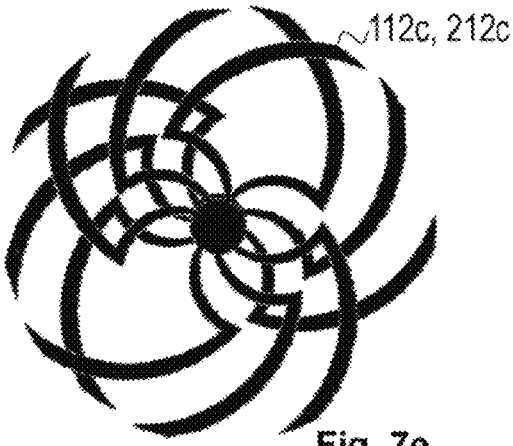
Figure 7F:
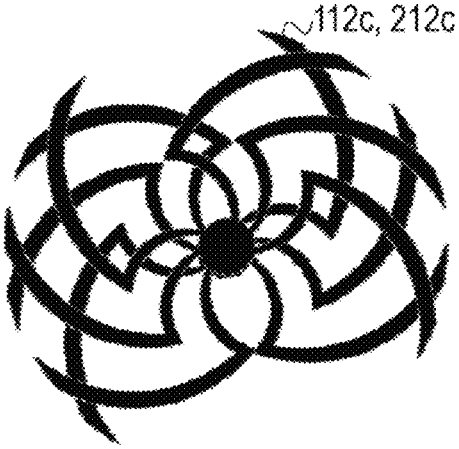
Figure 8A:
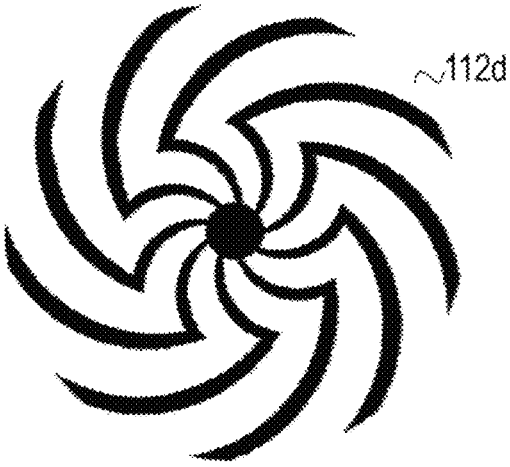
FIGS. 8*a* to 8*f* show a further example of gobo beam shaping object and a plate beam shaping object and the pattern when the gobo beam shaping object is rotated relative to the plate beam shaping object.
Figure 8B:
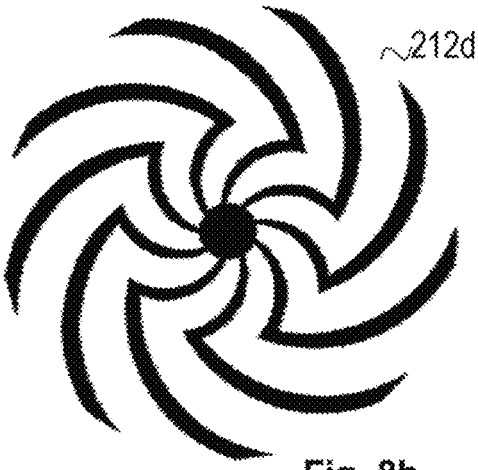
Figure 8C:
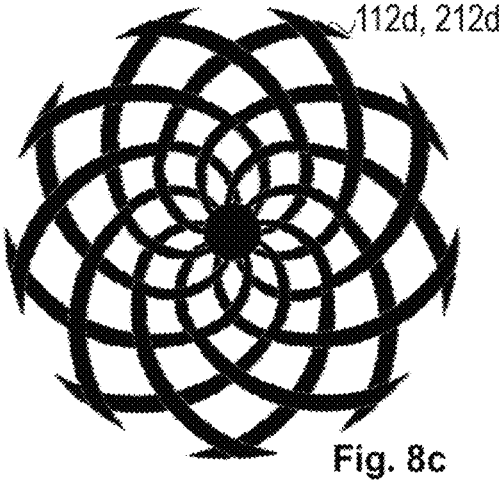
Figure 8D:
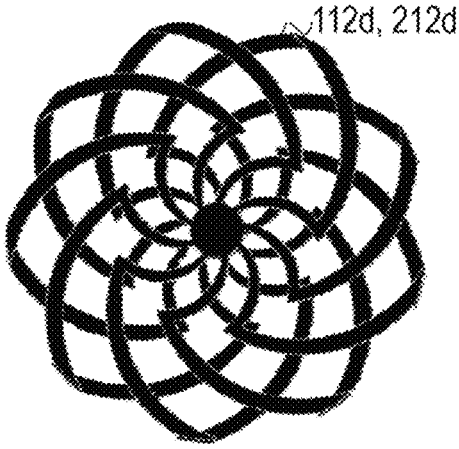
Figure 8E:
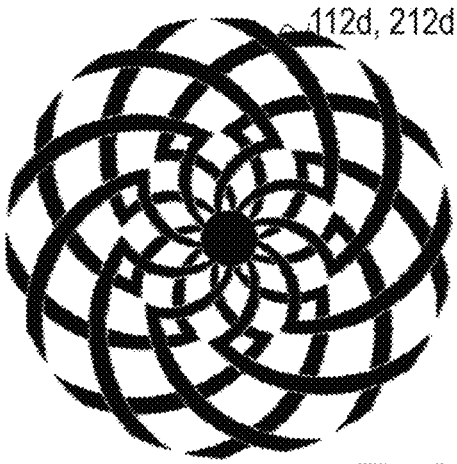
Figure 8F:
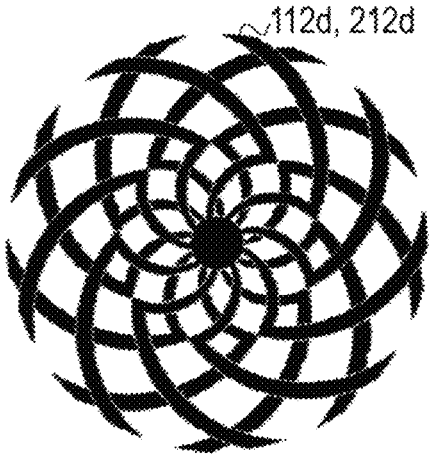

FIGS. 7*c*-7*f* show a further example of a gobo beam shaping object 112*c* in FIG. 7*a* and a plate beam shaping object 212*c* in FIG. 7*b* which are placed one above the other in order to obtain a pattern as shown in the left part in FIG. 7*c*. FIG. 7*c* shows the generated pattern by the light passed through the superposed gobo beam shaping pattern 112*c* and the plate beam shaping pattern 212*c* wherein in FIG. 7*d*, FIG. 7*e*, and FIG. 7*f* each show different rotation angles of the gobo beam shaping object 112*c* relative to the fixedly located plate beam shaping object 212*c* are shown., FIGS. 8*c*-8*f* show a further example of a gobo beam shaping object 112*d* shown in FIG. 8*a* and a corresponding plate beam shaping object 212*d* shown in FIG. 8*b*. In the embodiment shown a radial axis is provided and the shape of the radial components of the gobo beam shaping object are symmetrical to the shapes of the plate beam shaping object relative to axis. FIGS. 8*c*, 8*d*, 8*e* and 8*f* show again different rotation angles of the gobo beam shaping object 112*d* relative to the plate beam shaping object 212*d*.

Figure 9A:
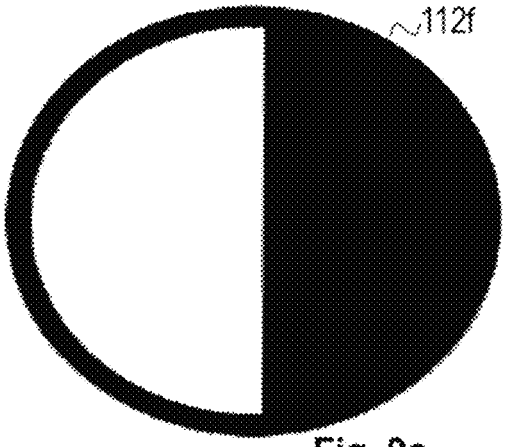
FIGS. 9*a* to 9*f* show a still further example of a gobo beam shaping object and a plate beam shaping object and the patterns obtained when the gobo beam shaping object is rotated relative to the plate beam shaping object.
Figure 9B:
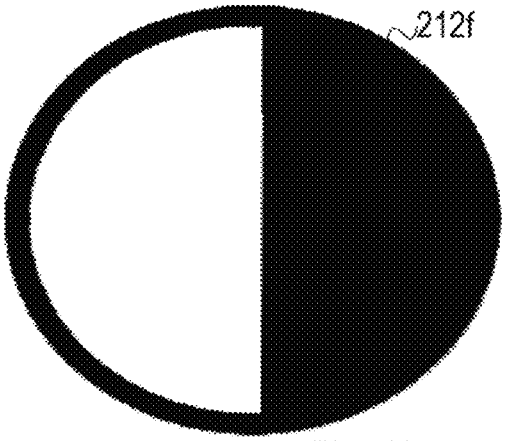
Figure 9C:
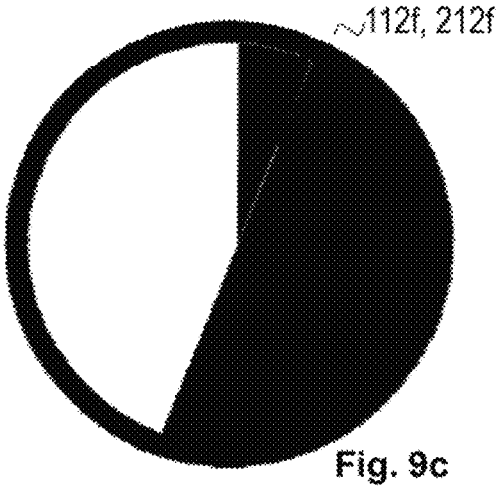
Figure 9D:
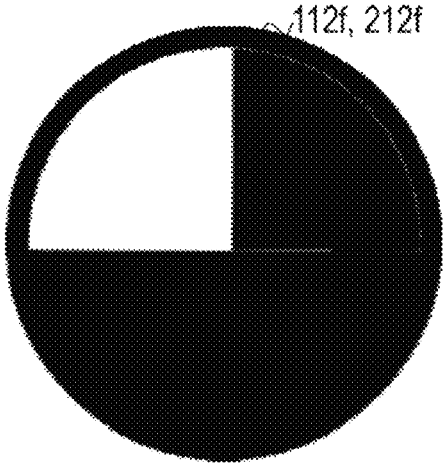
Figure 9E:
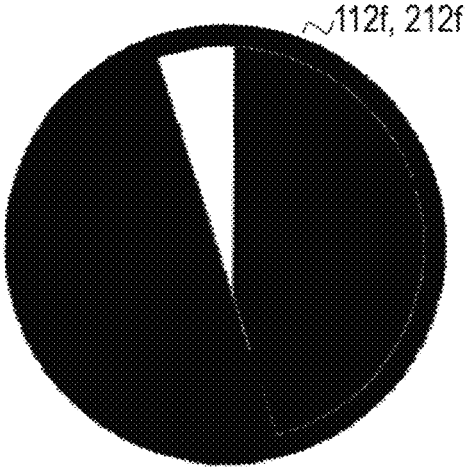
Figure 9F:
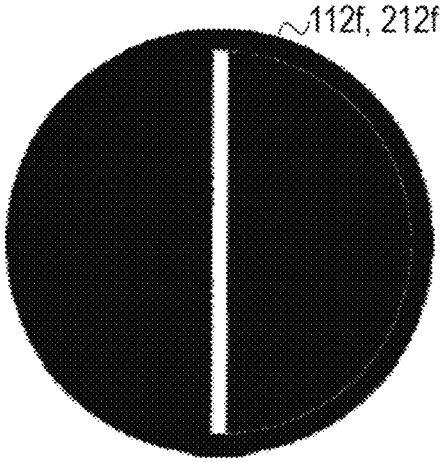

FIG. 9*a* shows a gobo beam shaping pattern 112 in the form of a segment of a circle and FIG. 9*b* shows a plate beam shaping pattern 212*f*. When they are placed one above the other and when the gobo beam shaping pattern is rotated relative to the plate beam shaping pattern, the patterns as shown in FIGS. 9*c*, 9*d*, 9*e* and 9*f* are obtained. From FIG. 9*f* it can be seen that each segment is slightly smaller than half the circle.

Figure 10A:
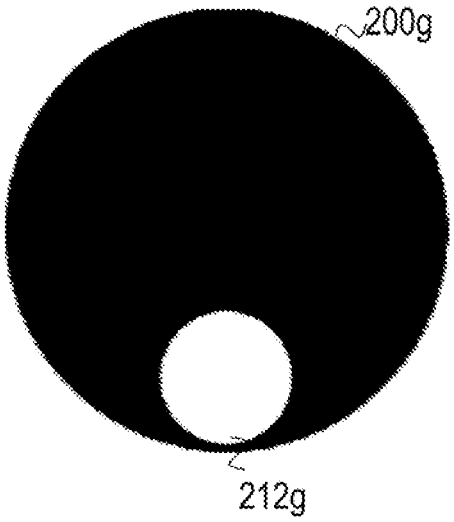
FIGS. 10*a* and 10*b* show a further example of gobo beam shaping objects and plate beam shaping objects.
Figure 10B:
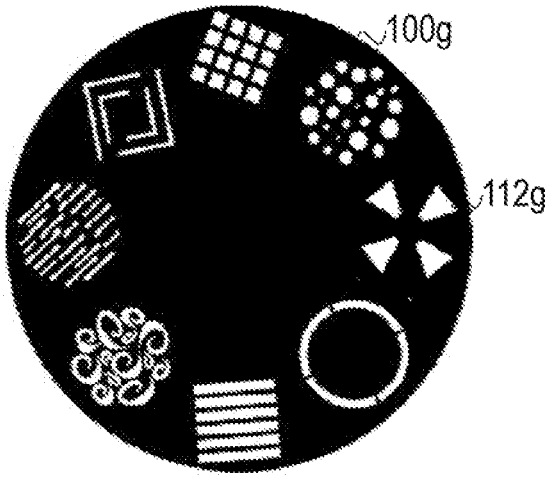

FIGS. 10*a* and 10*b* show a further example wherein FIG. 10*a* shows a beam shaping plate 200*g* with a single plate beaten shaping object 212*g*. FIG. 10*b* shows a support wheel 100*g* with different gobo beam shaping objects 112*g* wherein each gobo beam shaping object provided on the wheel 100*g* is different from the other beam shaping objects provided on the support wheel. When the wheel 100*g* is rotated around its axis, only the gobo beam shaping object located in front of the plate beam shaping object 212*g* is visible so that by rotating the wheel 100*g* the different gobo beam shaping objects are illuminated and shown as an image on the surface illuminated by the light fixture.

Figure 11A:
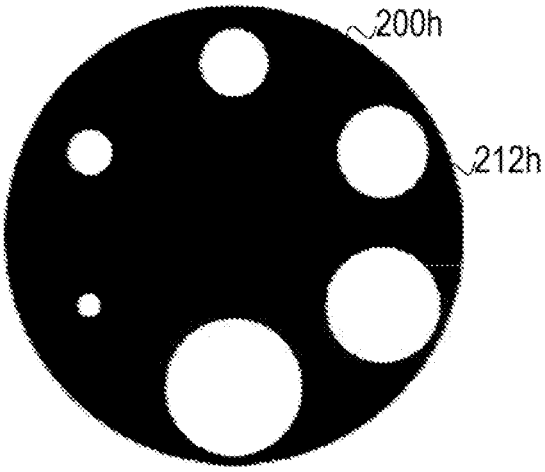
FIGS. 11*a* and 11*b* show a further example of gobo beam shaping objects and plate beam shaping objects.
Figure 11B:
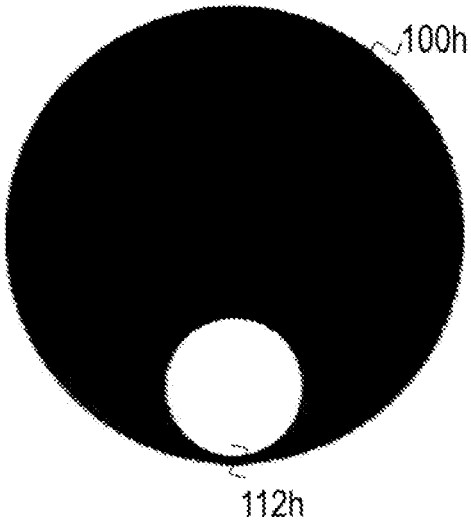

A similar embodiment is shown in FIG. 11*a* and 11*b* wherein 11*a* shows a beam shaping plate 200*h* with different plate beam shaping objects 212*h*. In the example the different plate beam shaping objects are circular through openings of different diameters. The support wheel 100*h* shown in FIG. 11*b* has a single gobo beam shaping object 112*h*, namely a circular through opening which approximately has the size of the largest through opening provided as a plate beam shaping object in plate 200*h*. When the gobo wheel is rotated circles of different diameters are imaged as the through openings provided in the beam shaping plate with different diameters determine the size of the through opening imaged by the illumination device.

Figure 12A:
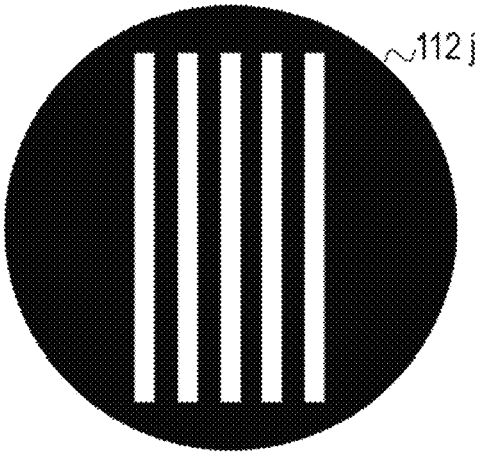
FIGS. 12*a* to 12*f* show a further example of a gobo beam shaping object and a plate beam shaping object and the patterns obtained when the gobo beam shaping object is rotated relative to the plate beam shaping object.
Figure 12B:
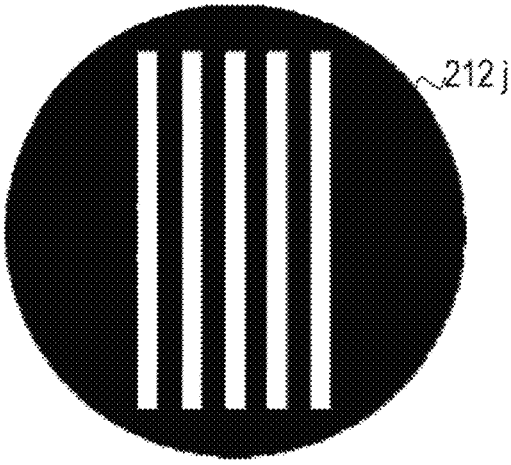
Figure 12C:
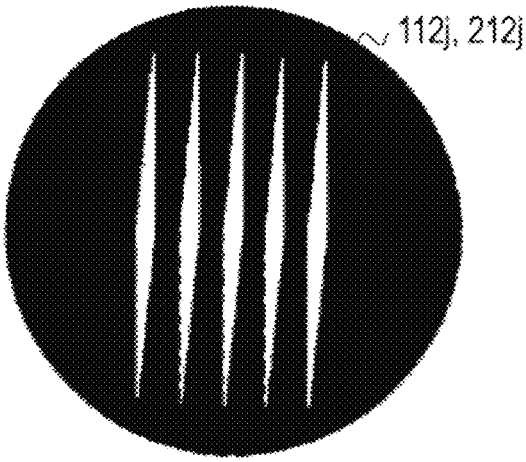
Figure 12D:
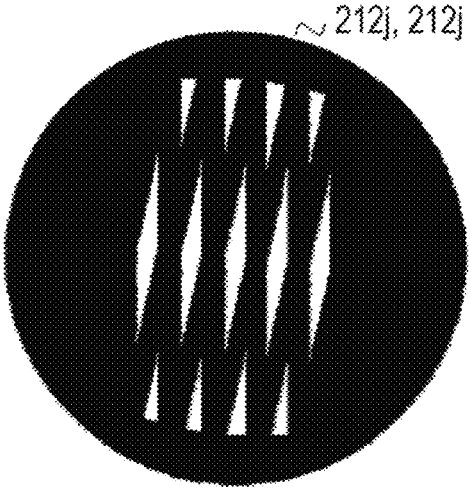
Figure 12E:
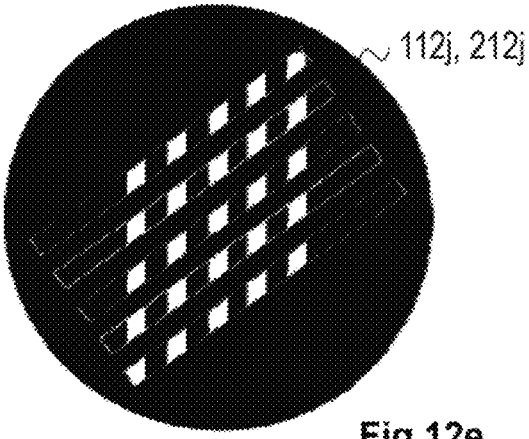
Figure 12F:
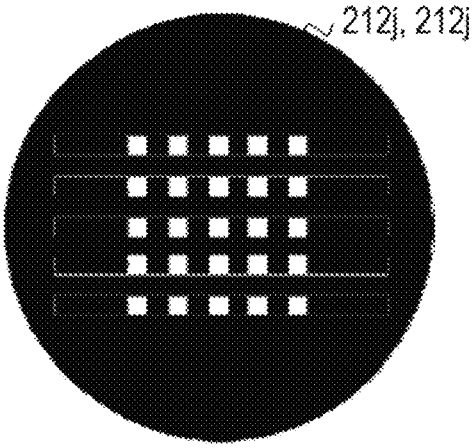

FIG. 12*a* shows a gobo beam shaping pattern 112*j*, whereas FIG. 12*b* shows the plate beam shaping object 212*j*. Both beam shaping objects have the form of several parallel rectangular openings and when the gobo beam shaping object is rotated relative to the plate beam shaping object, the shapes shown in FIGS. 12*c*, 12*d*, 12*e* and 12*f* are obtained.

Figure 13A:
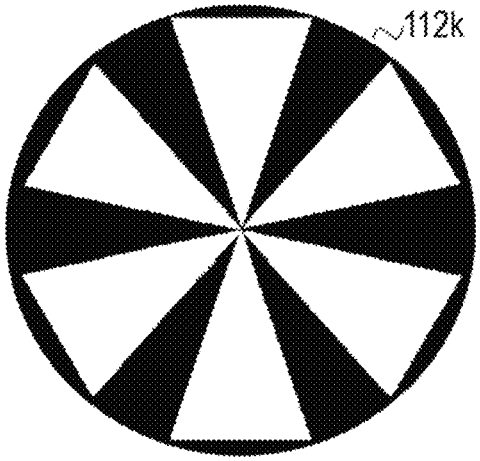
FIGS. 13*a* to 13*f* show a further example of a gobo beam shaping object and a plate beam shaping object at the patterns obtained when the gobo beam shaping object is rotated relative to the plate beam shaping object.
Figure 13B:
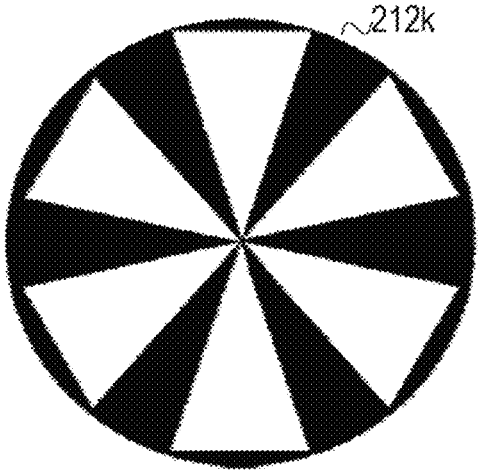
Figure 13C:
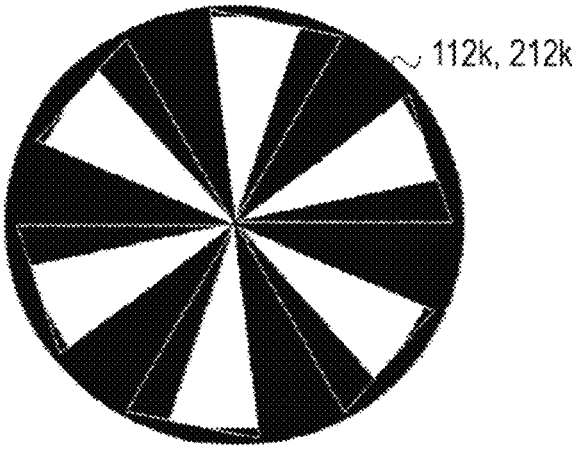
Figure 13D:
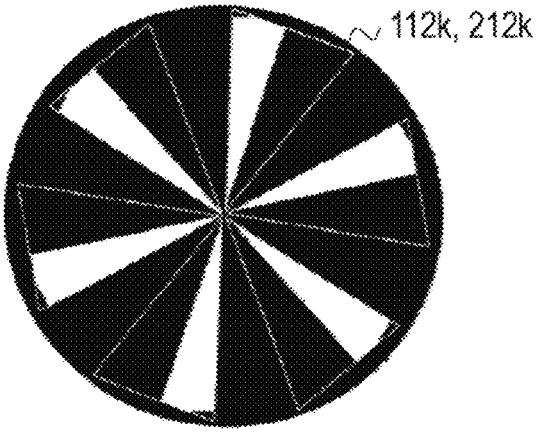
Figure 13E:
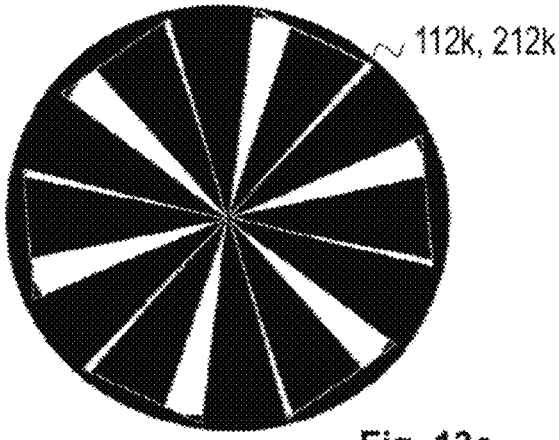
Figure 13F:
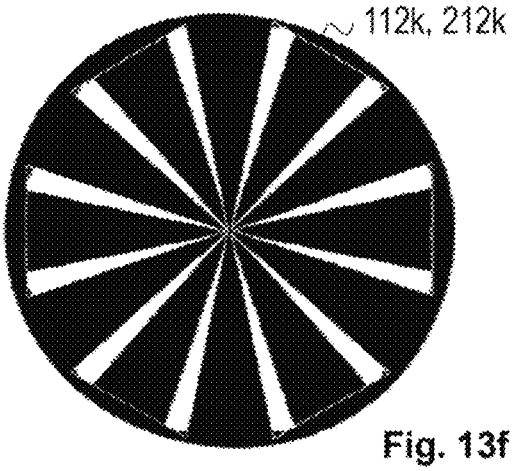

FIG. 13*a* shows a gobo beam shaping object 112*k* in the form of circular segments or triangles having a common apex. The plate beam shaping object 212*k* shown in FIG. 13*b* has the same shape so that one of the shaping objects is rotated relative to the other, different patterns as shown in FIGS. 13*c*, 13*d*, 13*e* and 13*f* are obtained.

As discussed above a static plate with different plate beam shaping objects and a single support wheel with several gobo wheels and gobo beam shaping patterns create different interesting light effects such as Moiré effects and moving objects. Furthermore, fixed patterns can be generated and can be used as static gobos. With the solution discussed above a variety of light effects can be obtained with a single rotating support wheel and animated effects or Moiré effects can be obtained. The rotating gobo wheels can be indexed so that the position of the separate gobo wheels can be controlled individually at different angles. Accordingly, different defined patterns in defined rotation angles between the gobo beam shaping object and the plate beam shaping object are possible.

The invention claimed is:

1. A projecting light fixture comprising:

at least one light source configured to generate at least one source light beam propagating along an optical axis;

an optical gate illuminated by the at least one source light beam;

a single support wheel having an axis, the Single support wheel is located near the optical gate, a plurality of gobo wheels are provided on the single support wheel, each gobo wheel has an axis and each gobo wheel has a gobo beam shaping object rotatable around its gobo wheel axis, the single support wheel is rotatable around the support wheel axis such that one of the plurality of gobo wheels is placed with its gobo beam shaping object in the at least one source light beam;

a beam shaping plate haying a plurality of plate beam shaping objects, the beam shaping plate is fixedly connected to the single support wheel in a position where each plate beam shaping object fixedly placed in front of one of the gobo wheels is facing the one gobo wheel, the least one source light beam passing through one of the gobo wheels is at least partly blocked by the gobo beam shaping object of the one gobo wheel and the corresponding plate beam shaping object facing the one gobo wheel; and a control unit configured to rotate each of the gobo wheels with its gobo beam shaping object relative to the beam shaping plate.

2. The projecting light fixture according to claim 1, wherein the control unit is configured to keep each rotating gobo wheel in different angular positions relative to the beam shaping plate such that in each of the different angular positions the gobo beam shaping object of the corresponding gobo wheel is facing its plate beam shaping object in different angular positions.

3. The projecting light fixture according to claim 1, further comprising, for at least some of the gobo wheels, a shape of the gobo beam shaping object and a shape of the plate beam shaping object facing the gobo beam shaping object are the same shape.

4. The projecting light fixture according to claim 3, wherein the plate beam shaping object and the gobo beam shaping object are each formed such that the at least one source light beam is able to pass the corresponding beam shaping object only in a rectangular section and light of the at least one light beam is blocked outside the rectangular section.

5. The projecting light fixture according to claim 3, wherein the plate beam shaping object and the gobo beam shaping object are each formed by a segment of a circle, the at least one source light beam is blocked outside the segment of the circle or is only blocked inside the segment of the circle.

6. The projecting light fixture according to claim wherein a shape of the plate beam shaping object differs from a shape of the gobo beam shaping object facing the plate beam shaping object.

7. The projecting light fixture according to claim 6, wherein the gobo beam shaping object and the plate beam shaping object each have radial components extending from a center of the gobo wheel radially outward, the radial components of the gobo and plate beam shaping objects are symmetrical to at least one radial axis extending from the center of the gobo wheel to an outer boundary of the gobo beam shaping object.

8. The projecting light fixture according to claim 6, wherein one of the gobo beam shaping object and the plate beam shaping object further comprises linear spokes extending radially outward from a center of the gobo wheel, whereas the other of the gobo beam shaping object and the plate beam shaping object comprises spokes with a spiral shape extending outward from the center of the gobo wheel.

9. The projecting light fixture according to claim 1, further comprising a projecting system configured to collect at least some of the source light beam after having passed the single support wheel and the beam shaping plate and to project the source light beam after having passed the single support wheel and the beam shaping plate along the optical axis.

10. The projecting light fixture according to claim 2, wherein the control unit is configured to control a rotating speed of each of the gobo wheels relative to the beam shaping plate.

11. The projecting light fixture according to claim 1, wherein the gobo beam shaping object and the plate wheel shaping object each have a circular outer boundary with a corresponding center, the center of the gobo beam shaping object and the center of the plate beam shaping object are located concentrically relative to the optical axis.

12. The projecting light fixture according to claim 2, wherein a shape of the plate beam shaping object differs from a shape of the gobo beam shaping object facing the plate beam shaping object.

* * * * *